United States Patent [19]

Tomosada et al.

[11] Patent Number: 4,743,944

[45] Date of Patent: May 10, 1988

[54] IMAGE PROCESSING APPARATUS WITH VARIABLE MAGNIFICATION

[75] Inventors: Masahiro Tomosada; Hideki Adachi, both of Kawasaki; Tadashi Suzuki, Yokohama; Naoyuki Ohki, Tokyo; Masanori Miyata, Yokohama, all of Japan

[73] Assignee: Canon Kabushiki Kaisha, Tokyo, Japan

[21] Appl. No.: 86,243

[22] Filed: Aug. 17, 1987

Related U.S. Application Data

[63] Continuation of Ser. No. 745,225, Jun. 17, 1985, abandoned.

[30] Foreign Application Priority Data

| | | | |
|---|---|---|---|
| Jun. 21, 1984 | [JP] | Japan | 59-126380 |
| Jun. 21, 1984 | [JP] | Japan | 59-126381 |
| Jun. 21, 1984 | [JP] | Japan | 59-126382 |
| Jun. 21, 1984 | [JP] | Japan | 59-126383 |
| Jun. 21, 1984 | [JP] | Japan | 59-126384 |
| Jun. 21, 1984 | [JP] | Japan | 59-126386 |

[51] Int. Cl.[4] ..... G03G 15/00

[52] U.S. Cl. ..... 355/14 R; 355/3 SH; 355/14 SH; 355/55

[58] Field of Search ..... 355/3 R, 3 SH, 14 SH, 355/14 R, 14 C, 55–57; 358/256, 280, 287, 282, 296

[56] References Cited

U.S. PATENT DOCUMENTS

| | | | |
|---|---|---|---|
| 3,689,143 | 9/1972 | Case et al. | 355/11 X |
| 3,912,387 | 10/1975 | Brooke | 355/3 R |
| 4,256,400 | 3/1981 | Komori et al. | 355/7 X |
| 4,277,163 | 7/1981 | Ikesue et al. | 355/14 |
| 4,351,606 | 9/1982 | Franko | 355/14 R |
| 4,411,516 | 10/1983 | Adachi et al. | 355/3 R |
| 4,417,805 | 11/1983 | Kishi | 355/7 X |
| 4,456,372 | 6/1984 | Yamanchi | 355/75 |
| 4,505,579 | 3/1985 | Furuichi et al. | 355/14 R X |

FOREIGN PATENT DOCUMENTS

| | | | |
|---|---|---|---|
| 0059083 | 9/1982 | European Pat. Off. . | |
| 3334362 | 3/1984 | Fed. Rep. of Germany . | |
| 54-54627 | 5/1979 | Japan | 355/14 SH |

OTHER PUBLICATIONS

*IBM Technical Disclosure Bulletin,* vol. 17, No. 3, Aug. 1974, Eckholm et al, "Document Detection", pp. 684–685.

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

An image processing apparatus includes a process unit for reproducing an image on a document onto a recording medium and a detection circuit for detecting the status of the document image. A control circuit controls the process unit to reproduce the document image at a predetermined magnification. The status of the document may include the area of the image on the document, whether the document image is adjacent an edge of the document, the location of the edge of the document, or the disposition of the document. The magnification of reproduction of the document image is then controlled by the control circuit in accordance with the detection of that particular status. For example, if it is determined that the document image is adjacent the edge of the document, reproduction is controlled to be at reduced magnification. If the document is determined to be away from a reference position, a portion of the reproduced image may be erased so that only the actual document image is reproduced rather than unwanted background adjacent the document.

12 Claims, 10 Drawing Sheets

IMAGE PROCESSING APPARATUS WITH VARIABLE MAGNIFICATION

This application is a continuation of application Ser. No. 745,225 filed June 17, 1985, now abandoned.

BACKGROUND OF THE INVENTION

1. Field of the Invention

The present invention relates to an image processing apparatus, and more particularly to an image processing apparatus for reproducing an image of a document.

2. Description of the Prior Art

In one prior art apparatus of this type, a size of a copy sheet to be fed is designated and a size of a document sheet detected by an appropriate method is compared with the copy sheet size to automatically set a copying magnification. However, when an image area in the document sheet is extremely smaller than the document sheet size, a blank area is created in a copy image and it makes the copy image hard to view.

In another prior art apparatus of this type, eraser means is provided to prevent deposition of toner to edges of a reproduced image. However, when an image exists in the edge areas on the document sheet and those areas should be copied, the information of the edges may be lost depending on illumination by the eraser means.

In other prior art apparatus of this type, a light is irradiated to a document sheet placed at a reference position on a document sheet table and an image is formed by a light reflected from the document sheet, and a size of the copy sheet loaded is detected to control an eraser in order to prevent deposition of unnecessary toner. However, if the document sheet is placed at a position different from the reference position on the document sheet table, the toner is deposited on undesired areas of the copy sheet.

In the prior art apparatus of this type, when a thick document such as a book is to be copied, the book is mounted on the document sheet table and the book is pressed by a document sheet pressing plate or other means to eliminates a gap between the original sheet table and the book, and the copy operation is carried out. However, even if the operator presses the book, a folding line of the book is not eliminated and undue pressure may be applied to the document sheet table and the document sheet table may be deformed. If the user carries out the copy operation without using the document sheet pressing plate, toner is attached to the edges and the folding line and the quality of the reproduced image is very poor.

SUMMARY OF THE INVENTION

It is another object of the present invention to provide an image processing apparatus which reproduces an image in an area of a copy sheet corresponding to an image area in a document sheet.

It is another object of the present invention to provide an image processing apparatus which prevents deposition of unnecessary toner to reproduce a sharp image.

It is another object of the present invention to provide an image processing apparatus which can produce an optimum copy without restriction by a position of a document sheet or a size of a copy sheet.

It is another object of the present invention to provide an image processing apparatus which can reproduce a desired image regardless of a type of document.

In accordance with one aspect of the invention there is provided an image processing apparatus comprising detection means for automatically detecting an image area in a document, input means for inputting a size of a recording sheet, and determination means for determining a magnification in accordance with the image area detected by said detection means and the size of the recording sheet.

In accordance with another aspect of the invention there is provided an image processing apparatus comprising process means for reproducing a document image onto a recording medium, detection means for detecting the status of the document image, said detection means including determination means determines whether an image is present at an edge or near of a document, and control means for controlling said process means to reproduce the doucument image at a predetermined magnification if said determination means determines the presence of image at the edge or near of the document.

In accordance with still another aspect to the invention there is provided an image forming apparatus comprising process means for performing a process for reproduction of a document image onto a recording medium, said process means including reproduction means for reproducing a latent image corresponding to the document image onto the recording medium and eraser means for removing charges on the recording medium, detection means for detecting the status of the document, and control means for controlling said eraser means in accordane with a detection output from said detection means in order to modify an edge of a reproduced image corresponding to the document image. The detection means may automatically detect whether the document is at a reference position.

In accordance with yet another aspect of the invention there is provided an apparatus comprising process means for performing a process for reproduction of a document image onto a recording medium, detection means for detecting the status of a document, determination means for determining whether the document is of a book, and control means for controlling said process means in accordance with a determination output from said determination means so as to modify a portion of a reproduced image corresponding to an image of the book when said determination means determines that the document is of a book.

DETAILED DESCRIPTION OF THE PREFERRED EMBODIMENTS

Figure 1:
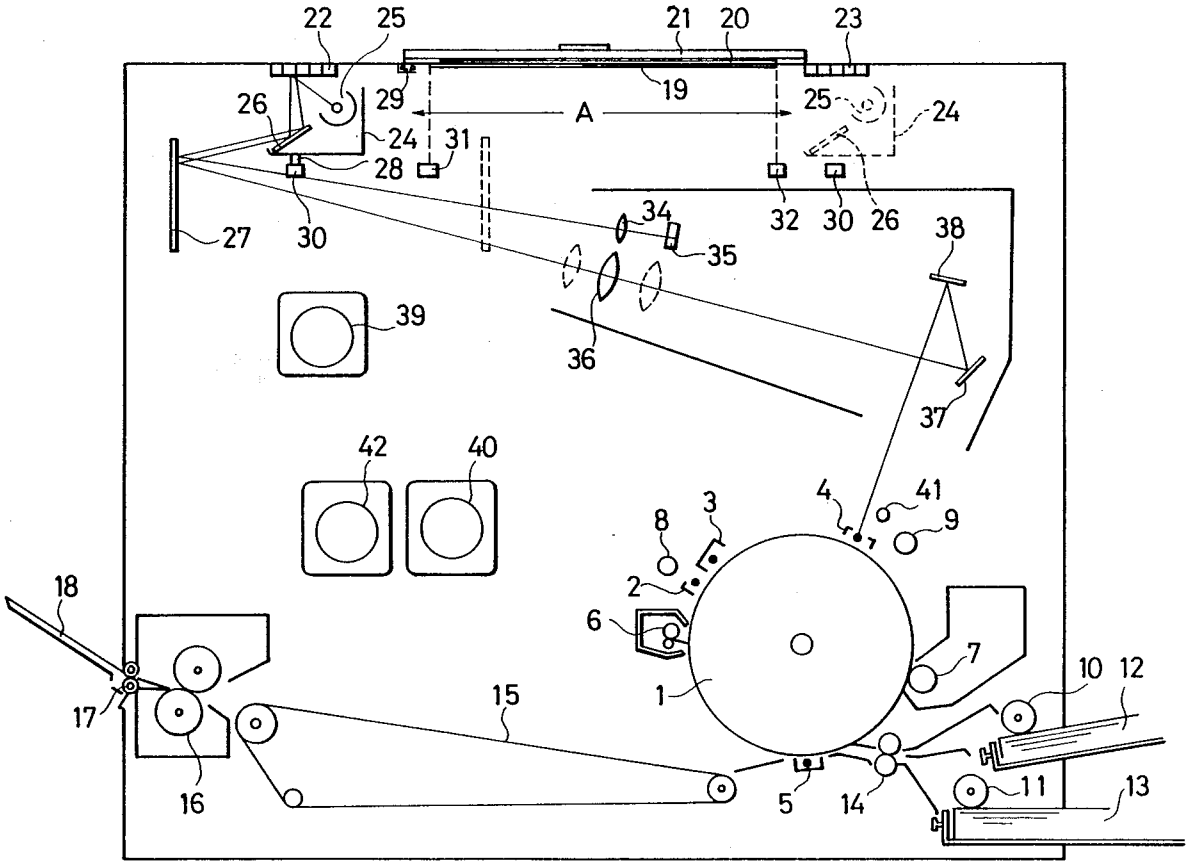
FIG. 1 is a sectional view of one embodiment of an image processing apparatus of the present invention.
Figure 2:
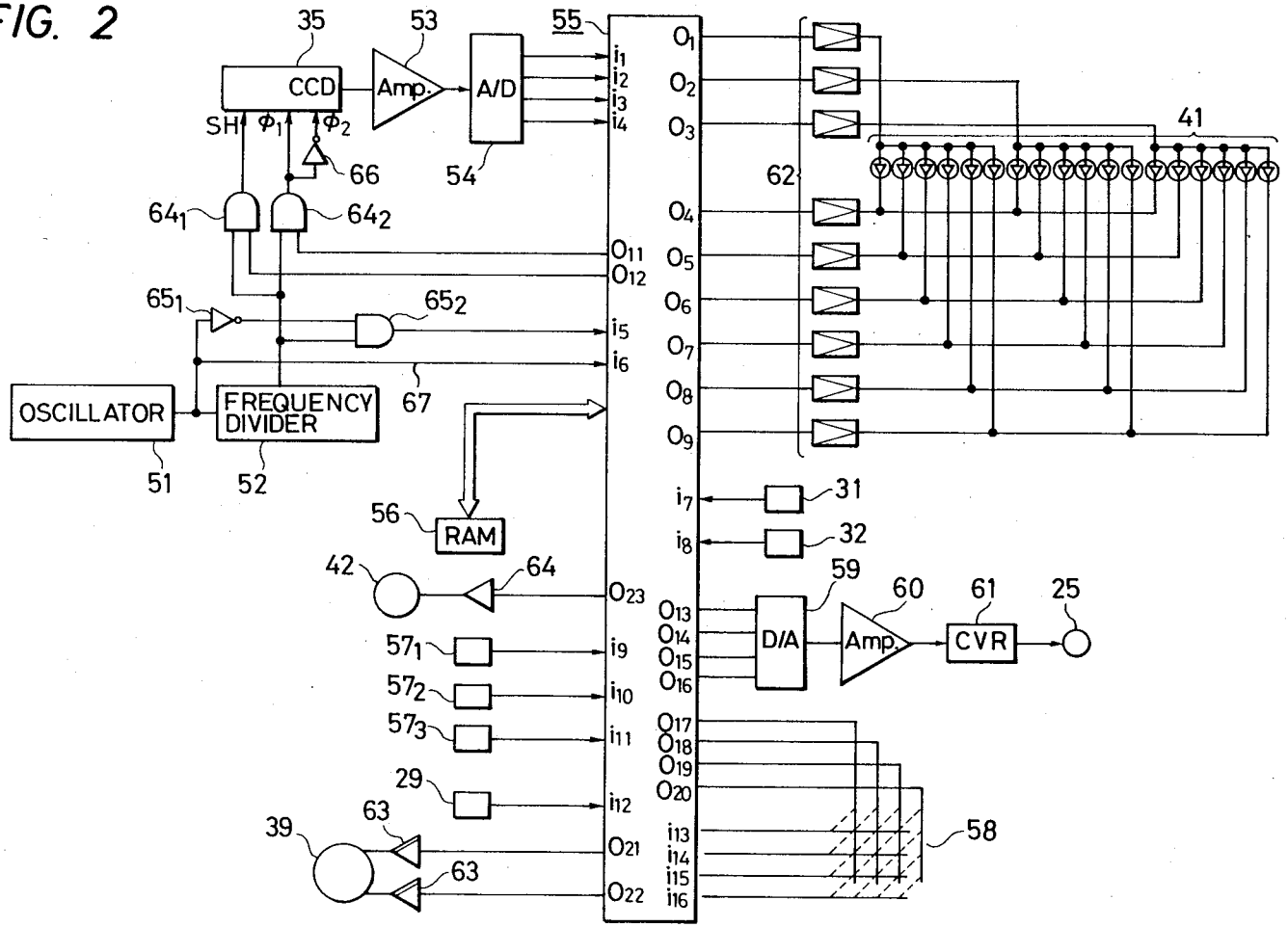
FIG. 2 shows a control circuit of the apparatus shown in FIG. 1.
Figure 3:
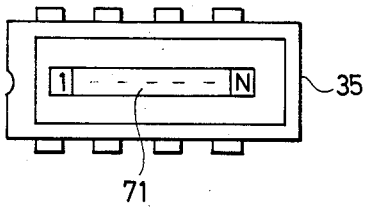
FIG. 3 shows a detail of a reflection density detector 35.

FIG. 1 is a sectional view of one embodiment of the image processing apparatus of the present invention, FIG. 2 shows a control circuit of the image processing apparatus and FIG. 3 is a front view of a reflection density detector.

In FIG. 1, numeral 1 denotes a drum, numeral 2 denotes a pre-discharger, numeral 3 denotes a primary charger, numeral 4 denotes a secondary charger which corona-discharges to the drum 1, numeral 5 denotes a transfer charger, numeral 6 denotes a cleaning device which comprises a cleaning roller and a resilient blade, numeral 7 denotes a developing unit, numeral 8 denotes a pre-exposure lamp which discharges the drum 1, numeral 9 denotes a flat exposure (overall exposure) lamp which forms an electrostatic latent image on a drum 1, numerals 10 and 11 denote paper feed rollers, numeral 12 denotes an upper cassette which accommodates copy sheets therein, numeral 13 denotes a lower cassette, numeral 14 denotes a resistration roller, numeral 15 denotes a convey belt, numeral 16 denotes a fixing roller, numeral 17 denotes an eject roller, numeral 18 denotes a tray, numeral 19 denotes a document sheet glass, numeral 20 denotes a document sheet, numeral 21 denotes a document sheet pressing plate having a surface contacting to the document sheet 20 mirror-finished or coated with low reflection factor material, numerals 22 and 23 denote standard white plates, numeral 24 denotes a moving optical system unit which comprises an illumination (irradiation) lamp 25 and a first scan mirror 26, numeral 27 denotes a second scan mirror, numeral 28 denotes a position detection member (a projection to be detected) mounted on an outer side of the moving optical system unit 24, numeral 29 denotes a switch for detecting a contact status of the document sheet pressing plate 21 and the document sheet glass 19, numerals 30, 31 and 32 denote position sensors which sense the position detection member 28, numeral 34 denotes a document detection lens for focusing a reflected light directed to the first scan mirror 26 and the second scan mirror 27, and numeral 35 denotes a reflection density detector which is a one-line array of photosensing devices such as a CCD and arranged in a direction B of main scan (normal to a sub-scan direction A), which detects a document sheet size of the document sheet 20 placed on the document sheet glass 19, an image area in the document, a reflection density of the document, and a document position in a copy permitted area. The document detection lens 34 and the reflection density detector 35 are fixed at predetermined positions in the apparatus. Numeral 36 denotes a projection lens for focusing the reflection light directed to the second scan mirror 27, numeral 37 denotes a third reflection mirror, numeral 38 denotes a fourth reflection mirror, numeral 39 denotes an optical system drive motor which drives the optical system unit 24, numeral 40 denotes a main motor which drives the drum 1, numeral 42 denotes a motor which drives the projection lens 36, and numeral 41 denotes an eraser which prevents deposition of toner to a non-image area on the drum 1. The eraser comprises LED's each corresponding to the photosensing devices of the reflection density detector 35. The LED's of the eraser 41 are arranged in one line in the main scan direction B.

In the control circuit shown in FIG. 2, numeral 51 denotes an oscillator which generates a clock signal, numeral 52 denotes a frequency divider, numeral 53 denotes an amplifier for amplifying a detection signal of the reflection density detector 35, numeral 54 denotes an A/D converter which converts an analog output of the amplifier 53 to a digital signal which is supplied to input ports $i_1$–$i_4$, and numeral 55 denotes a microprocessor (MP) which receives the sensor outputs, the output of the reflection density detector 35 and the timing signals through input ports and outputs control signals through output ports. The MP 55 has an internal timer. Numeral 56 denotes a random access memory (RAM) which is randomly accessed by the MP 55, numerals $57_1$–$57_3$ denote cassette size input keys by which cassette sizes are inputted to the input ports $i_9$–$i_{11}$ of the MP 55, numeral 58 denotes input keys including a copy start key, a ten-key and a clear key by which a copy start signal, a copy count signal and a clear signal are inputted to the input ports $i_{13}$–$i_{16}$ of the MP 55. Numeral 59 denotes a D/A converter which converts a lamp signal supplied from the MP 55 through the output ports $O_{1-3}$–$O_{16}$ to an analog signal, which is supplied to the illumination lamp 25, numeral 60 denotes an amplifier which amplifies the lamp signal, numeral 61 denotes a lamp regulator (CVR) which controls the voltage to the illumination lamp 25, numeral 62 denotes drivers which drive eraser 41 in response to eraser drive control signals supplied from the MP 55 through the output ports $O_1$–$O_9$, numeral 63 denotes drivers which drive the optical system drive motor 39 in response to motor drive control signals supplied from the MP 55 through the output ports $O_{21}$ and $O_{22}$, numeral 64 denotes a driver which drives the lens drive motor 42 and which is connected to the output port $O_{23}$, numeral $64_1$ denotes an AND circuit which ANDs the output signal of the frequency divider 52 and the control signal supplied from the MP 55 through the output port $O_{12}$ and which supplies a shift pulse (SH) to the reflection density detector 35, numeral $64_2$ denotes an AND circuit which ANDS the output signal of the frequency divider 52 and the control signal supplied from the MP 55 through the output port $O_{11}$ and which supplies a clock signal $\phi_1$ to the reflection density detector 35, numeral $65_1$ denotes an inverter which inverts the signal supplied from the oscillator 51, numeral $65_2$ denotes an AND circuit which ANDs the output of the frequency divider 52 and the output of the inverter 65, and supplies an A/D in signal to the input port $i_5$ of the MP 55, numeral 66 denotes an inverter which inverts the clock signal $\phi_1$ supplied from the AND circuit $64_2$ and supplies a clock signal $\phi_2$ to the reflection density detector 35, and numeral 67 denotes a clock signal supplied to the input port $i_6$ of the MP 55. The output of the switch 29 is supplied to the input port $i_{12}$ of the MP 55.

Figure 4:
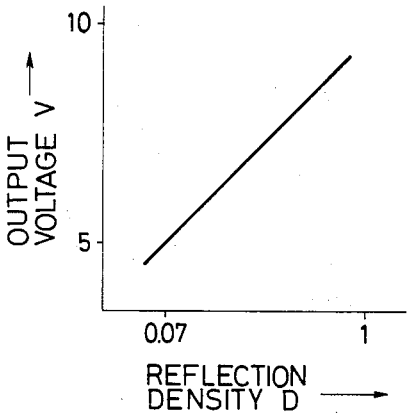
FIG. 4 is a density graph showing a relationship between a reflection density and an output voltage.

In the reflection density detector 35 shown in FIG. 3, numeral 71 denotes photosensitive devices 1~N arranged in a line which receive the reflection light in the main scan direction of the document sheet to produce an output voltage (V) which represents the reflection density (D) as shown in FIG. 4.

Referring to FIGS. 1 and 2, the exposure of the document sheet and the copy operation of the image processing apparatus are explained.

The drum 1 has a photosensitive member on the surface thereof and is rotated in a direction of an arrow by the main motor 40 which is activated by depressing the copy start key of the input keys 58. When the drum 1 has been rotated by a predetermined rotation angle and the pre-processing is terminated, the document sheet 20 placed on the document sheet glass 19 (a maximum area on the document sheet glass 19 which can be copied is hereinafter referred to as a copy permitted area) is illuminated by the illumination lamp 25 which is in union with the optical system drive unit 24, and the reflected light is scanned by the first scan mirror 26 and the second scan mirror 27 which are moved at speed ratio of 2/1 so that the document sheet 20 is scanned while an optical path length in front of the projection lens 36 is always kept constant. The moving optical system unit 24 is driven by the optical system drive motor 39. The reflected light passes through the projection lens 36, a third mirror 37 and a fourth mirror 38 and is focused onto the drum 1 at the exposing station. The drum 1 is discharged by the pre-exposure lamp 8 and the pre-discharger 2, and then corona-charged (for example, positively) by the primary charger 3. A slit image illuminated by the illumination lamp 25 is exposed to the drum 1 at the exposure station. The drum 1 is then AC-discharged or corona-discharged with the opposite polarity (negatively) to the polarity of corona charging, by the secondary charger 4, and flat-exposed by the flat exposure lamp 9 so that a high contrast electrostatic latent image is formed on the drum 1. The electrostatic latent image is formed on the drum 1 is developed by the developing roller of the developing unit 7 so that it is visualized as a toner image, which is then transferred to a copy sheet by the transfer charger 5. After the transfer, the drum 1 continues the rotation and is cleaned by the cleaning roller and the resilient blade of the cleaning unit 6 so that it is prepared for the next imaging.

The copy sheet accommodated in the upper cassette 12 or the lower cassette 13 is fed into the apparatus by the paper feed roller 10 or 11, and the registration roller 14 temporarily stops the movement of the copy sheet toward the drum 1 to align the leading edge of the copy sheet and the leading edge of the latent image, and then the copy sheet is fed toward the drum 1. While the copy sheet passes between the transfer charger 5 and the drum 1, the toner image on the drum 1 is transferred to the copy sheet. After the transfer, the copy sheet is separated from the drum 1, guided to the fixing roller 16 by the convey belt 15, and pressed and heated to fix the transferred image. Then, the copy sheet is ejected to the tray 18 by the eject roller 17.

The detection of the document sheet position, document sheet size and document density is now explained.

After the turn-on of the main switch, the optical system drive motor 39 is driven to drive the moving optical system unit 24 until the position sensor 30 for the standard white plate 22 detects the position detection member 28 mounted on the outside of the moving optical system unit 24 in order to correct a variation in the characteristics of the photosensing devices 71 of the reflection density detector 35 and the ripple in the light source. As the illumination lamp 25 illuminates the standard white plate 22 which presents a uniform reflection density, the reflection light is directed to the reflection density detector 35 through the first scan mirror 26, second scan mirror 27 and document sheet detection lens 34. The reflection density is stored in the RAM 56 as a density correction value. Then, the optical system drive motor 39 is driven to drive the moving optical system unit 24 until the position sensor 31 for the leading position in the copy permitted area detects the position detection member 28. The copy permitted area on the document sheet glass 19 on which the document sheet 20 is mounted with the document sheet pressing plate 21 being closed is illuminated by the illumination lamp 25 to measure the reflection density of the copy permitted area.

Figure 5:
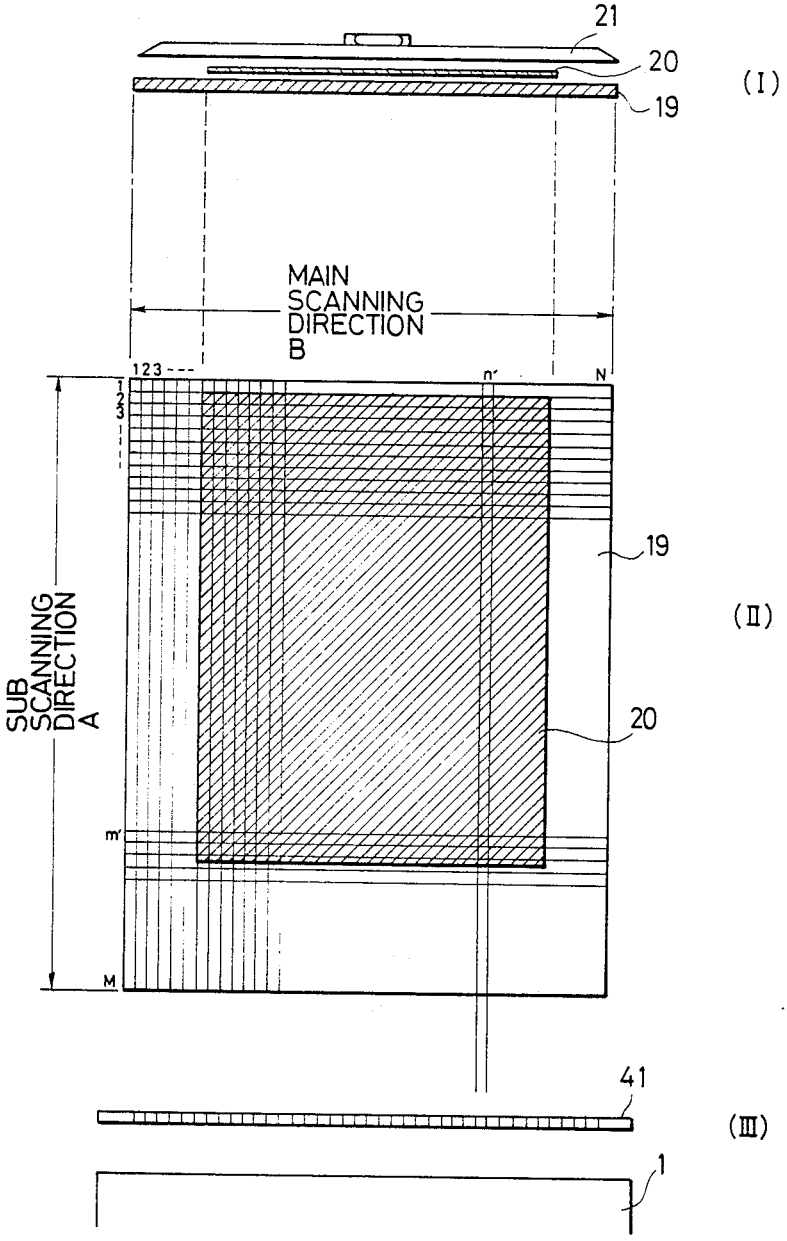
FIG. 5 illustrates a copy permitted area and a document read status.

FIG. 5 shows a correlation between the document sheet 20 and the eraser 41. In FIG. 5(I), the document sheet 20 is held between the document sheet glass 19 and the document sheet pressing plate 21, in FIG. 5(II) the document sheet 20 is mounted on the copy permitted area on the document sheet glass 19, and in FIG. 5(III) the eraser 41 is shown on the drum 1. In FIG. 5(II), A represents the sub-scan direction, B represents the main scan direction and hatched area is the document area. Numerals 1~n'~N and 1~m'M denote sub-areas divided in correspondence with the photosensing devices 71 of the reflection density detector 35. The present apparatus reads the image densities of the entire copy permitted area in one scan.

As the moving optical system unit 24 is moved, the reflection density detector 35 having the photosensing devices 71 arranged in the main scan direction B of FIG. 5(II) detects the reflection density of the entire copy permitted area, the reflection density is corrected by the density correction value and the corrected image density is stored in the RAM 56. The moving optical system unit 24 is moved in the sub-scan direction A at a constant velocity (e.g. 260 mm/sec for unity magnification), the illumination lamp 25 is lit, the reflection density of the entire copy permitted area on the document sheet glass 19 is detected, the reflection density is corrected by the density correction value, and the corrected image density is stored in the RAM 56. In this manner, the reflection density of each of finely divided sub-areas of the copy permitted area is detected. Based on the corrected image densities, the document sheet size, the image area in the document, the maximum reflection density and the minimum reflection density are obtained. The MP 55 sends control signals based on those information.

If the standard white plate 23 is disposed near the rear end of the copy permitted area as shown in FIG. 1, the position of the moving optical system unit 24 is detected by the position sensor 30, then the standard white plate 23 is illuminated, the density correction value is obtained, the moving optical system unit 24 is scanned in the sub-scan direction A from the position of the position sensor 32 which indicates the rear end of the copy permitted area to the position of the position sensor 31, and the reflection densities of the finely divided sub-areas of the copy permitted area are measured.

Figure 6:
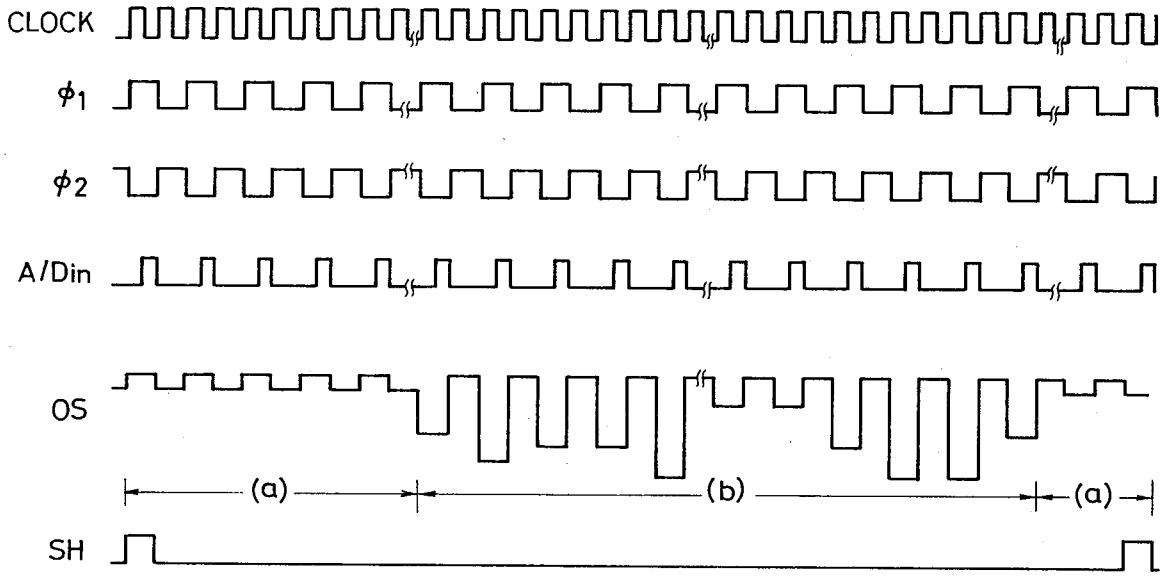
FIG. 6 is a timing chart of control signals.

The control circuit of the apparatus is explained with reference to the diagram of the control circuit shown in FIG. 2 and the control signal timing chart shown in FIG. 6.

After the turn-on of the main switch, the MP 55 produces the motor control signal at the output ports $O_{21}$ and $O_{22}$ to drive the optical system drive motor 39 in order to measure the reflection density of the standard white plate 22. The moving optical system unit 24 is moved until the position sensor 30 detects the position detection member 28, and then the illumination lamp 25 is turned on to illuminate the standard white plate 22. The shift pulse signal SH shown in FIG. 6 is supplied to the reflection density detector 35, and the clock signal CLOCK generated by the oscillator 51 is frequency-divided by the frequency divider 52 to produce the clock signal $\phi_1$ and the inverted clock signal $\phi_2$, which are also supplied to the reflection density detector 35.

The reflection light from the standard white plate 22 is detected by the photosensing devices 71 1~N and the output voltage is amplified by the amplifier 53 and the output signal OS thereof is converted to the digital signal by the A/D converter 54. A predetermined number of signals are processed as a dummy signal (a) shown in FIG. 6 (dummy processing). In the dummy processing, unnecessary signal (dummy signal) in one scan line of signal produced by the reflection density detector 35 is eliminated. Then, the reflection density is read in at the timing designated by the signal A/D as shown in FIG. 6, and after the detection signal (b) has been read in, the predetermined number of dummy signals (a) are counted, and the dummy processing is again carried out. The reflection density data is stored in the designated area of the RAM 56 as the density correction value after the dummy processing, the MP 55 turns off the illumination lamp 25 and stands by the depression of the copy start key of the input keys 58.

When the copy start key signal is applied to the MP 55, the MP 55 turns on the optical system drive motor 39 and the illumination lamp 25, and moves the moving optical system unit 24 until the position sensor 31 detects the position detection member 28, and then starts to read the document image. While the moving optical system unit 24 moves in the sub-scan direction A shown in FIG. 5, the MP 55 starts the internal timer to produce the shift pulse signal SH of the predetermined interval (e.g. 10 msec) to be supplied to the reflection density detector 35. The shift pulse signal SH is produced each time the internal timer times out. The MP 55 starts to count the A/D in signals to carry out the dummy processing with the shift pulse signal SH. After the predetermined number of A/D in signals have been counted, the dummy processing is terminated and the reflection density data 1~N are subsequently and sequentially read into the input ports $i_1$–$i_4$ of the MP 55 at the timing designated by the A/D in signals. The reflection density data is corrected by the density correction value stored in the RAM 56 and the corrected image density data is stored in the designated area of the RAM 56. After the reflection density data 1~N have been inputted, the MP 55 again carries out the similar dummy processing until the predetermined number of A/D in signals are counted, and after the dummy processing, the MP 55 stands by until the internal counter times out. When the internal timer times out, the shift pulse signal SH is applied to the reflection density detector 35 and the internal timer is again started, and the above steps are repeated.

The above operation is repeated from 1 to M in the sub-scan direction A. The image density in the copy permitted area is obtained from the reflection density detected by the reflection density detector 35, and the document sheet size, document sheet position and document density, i.e., the general status of the document, are determined from the image density. In the second scan for actually forming the image, the driver 62 is activated in accordance with the document sheet position, the signals for controlling the eraser 41 are produced at the output ports O–$O_9$ to prevent the deposition of toner to the non-image area on the photosensitive material 1. The bias of the developing unit 7 and the light intensity of the illumination lamp 25 are controlled in accordance with the document density stored in the RAM 56 so that an optimum contrast is obtained.

The control of the eraser 41 by the reflection density detected by the reflection density detector 35 is now explained with reference to FIGS. 1 and 2.

The eraser 41 emits lights in correspondence to pixels of the photosensing devices 71 of the reflection density detector 35. An aggregation of pixels having higher densities than the predetermined reflection density, that is, non-image area is obtained from the image densities stored in the RAM 56. The LED's of the eraser 41 corresponding to the non-image area are turned on in accordance with the copy magnification to prevent the deposition of toner to the non-image area on the photosensitive drum 1.

The reflection factor of the pixels on the border line of the non-image area and the document area is lower than the reflection factor of a white background document if the document sheet pressing plate 21 is mirror-finished. If the development is done under this condition, toner is deposited to the edges of the document area. In order to prevent this, the LED's of the eraser 41 corresponding to the pixels on the border line of the non-image area and the document area are turned on to prevent the deposition of toner (edge processing).

When the switch 29 mounted near the document sheet table is turned off and the signal indicating the non-contact of the document sheet pressing plate 21 and the document sheet glass 19 is supplied to the input port $i_{12}$ of the MP 55, the MP 55 determines that the document 20 is a book. Thus, the aggregation of edges of the book is determined until the reflection density detector 35 detects the document edge and then detects the white reference having a higher reflection factor than a predetermined value, and the control signals are produced at the output ports $O_1$–$O_9$ to turn on the LED's of the eraser 41 corresponding to the aggregation of edges. The driver 62 responds to those control signals to turn on the LED's corresponding to the aggregation of edges. In this manner, the deposition of toner to the aggregation of edges, which occurs when a book is copied with two pages open, is prevented (book mode). When the document 20 is the book and the reflection densities detected by the reflection density detector 35 includes a reflection factor for a half-tone area at a center of the document which is lower than a predetermined reflection factor, and an aggregation of half-tone areas exists in the edge (spine) direction of the document sheet 20, the MP 55 determines that the half-tone area is due to the folding line of the book and produces control signals at the output ports $O_1$–$O_9$ to turn on the LED's corresponding to the half-tone area. The driver 62 responds to those signals to turn on the LED's corresponding to the half-tone area. In this manner, the deposition of toner to the half-tone area (the folding line position of the book on the photosensitive drum 1) is prevented.

The edge control in the copy permitted area is now explained. It is assumed that the document sheet pressing plate 21 is mirror-finished.

The reflection densities of the pixels in the copy permitted area are detected by the photosensitive devices 71 of the reflection density detector 35. Following to an aggregation of low reflection factor pixels, an aggregation of high reflection factor pixels (document area) is detected. The document sheet position and the document sheet size, i.e., the general status of the document, are detected from the border line of the aggregation of the low reflection factor pixels and the aggregation of high reflection factor pixels. If the document 20 is copied in accordance with the document sheet size and the document sheet position stored in the RAM 56, the image of the document 20 on the border line as well as the images on the edges are protected from toner deposition by the eraser. Whether the edge processing is necessary or not is determined based on the reflection factor of the pixel next to the border line. If the pixel next to the border line has a character printed thereon, the reflection factor is low. Thus, if the reflection factor of the pixel next to the border line is lower than a predetermined value, the MP 55 determines that toner should be deposited to the pixels on the edges of the document and selects a predetermined reduction copy scale (e.g. 98%), and if the reflection factor of the pixel next to the border line is higher than the predetermined value, the MP 55 selects the unity copy scale. Thus, if the characters exist around the border line, the reduction copy scale is selected so that the characters around the border line are not affected by the edging process by the LEDs of the eraser 41.

The control of the automatic magnification selection is now explained. An automatic magnification selection (AMS) key is provided in the input keys 58 of the present apparatus. When the AMS key is depressed, the automatic magnification selection mode is set to automatically set the magnification in accordance with the image area in the document sheet and the designated copy sheet size. The detection densities of the pixels in the copy permitted area are detected by the photosensing devices 71 of the reflection density detector 35, with the aggregation of high reflection factor pixels being followed by the aggregation of low reflection factor pixels. The image area is detected based on the border line of the aggregation of high reflection factor pixels and the aggregation of low reflection factor pixels. The image area is compared with the copy sheet size of the copy sheet accommodated in the upper cassette 12 or lower cassette 13, which is derived from the cassette size input keys $57_1$–$57_3$, and if the copy sheet of the same size is accommodated in the upper cassette 12 or lower cassette 13, the unity magnification copy is made. On the other hand, if the image area size is different from the copy sheet size, a most appropriate reduction scale or magnification scale is selected such that the entire image area is copied on the copy sheet, and the copy is made at the selected magnification. In the automatic magnification selection mode, the magnification may be selected such that a margin of a predetermined width appears on the copy sheet.

Figure 7:
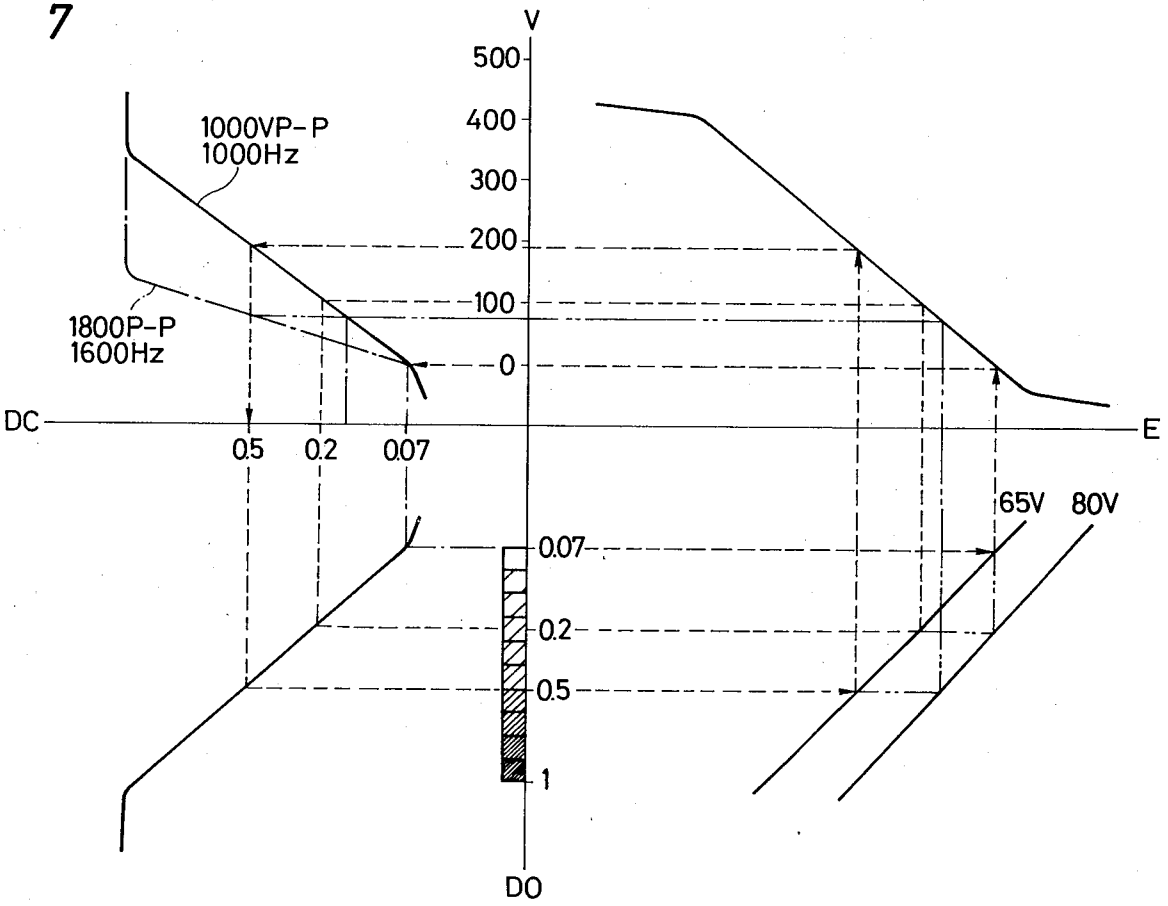
FIG. 7 shows density characteristics.

The automatic density control is now explained with reference to FIGS. 1, 2 and 7. FIG. 7 shows density characteristics in which a first quadrant shows a relationship between an exposure amount (E) and a potential (V) of the drum 1, a second quadrant shows a relationship between the potential (V) of the drum 1 and a density (DC) of a copy image, a third quadrant shows a relationship between the density of the copy image and a document density (DO) derived from the reflection density detected by the reflection density detector 35, and a fourth quadrant shows a relationship between the document density (DO) and the exposure amount (E).

The reflection densities of the pixels of the copy permitted area are detected by the photosensing devices 71 of the reflection density detector 35 with the aggregation of high reflection factor pixels being followed by the aggregation of low reflection factor pixels. Assuming that the pixel having the highest reflection factor in the aggregations of pixels (background, standard white level) has a density 0.07 and the pixel having the minimum reflection factor has a density 0.5, an input voltage of 65V is applied to the illumination lamp 25, the potential of the drum 1 is determined by the E-V characteristic shown in the first quadrant and a copy image having a density determined by a 1000Hz, 1000 $V_{p-p}$ curve of the development characteristic shown in the second quadrant. In the present example, the document density 0.07 is developed to have a copy density 0.07, and the document density 0.5 is developed to have a copy density 0.5. Thus, the document density and the copy mode are equal. If a difference between the maximum and minimum document densities is smaller than a predetermined value, the copy density is changed in the following manner.

For example, if the minimum document density is 0.2 and the maximum density is 0.5 and the E-V characteristic in the first quadrant remains unchanged, the input voltage to the illumination lamp 25 shown in the fourth quadrant is set to 80 V so that the document density 0.2 is changed to the copy density 0.07. The development characteristic of the second quadrant is set to the 1600 Hz, 1800 $V_{p-p}$ curve. In this manner, if the difference between the maximum and minimum document densities is smaller than the predetermined value, that is, if the contrast of the document 20 is low, the contrast can be increased to reproduce a high contrast image.

The control of the register roller 14 and the eraser 41 relative to the document sheet position, will now be explained.

The document sheet glass 19 has a predetermined document sheet reference position and if a deviation of the leading edge of the document sheet from the document sheet reference position is detected from the reflection density detected by the reflection density detector 35, the LED's of the eraser 41 corresponding to the deviation area of the document sheet from the document sheet reference position are turned on to prevent the deposition of toner and the drive timing to the regist roller 14 is retarded so that the leading edge of the copy sheet and the leading edge of the image area are registered. In this manner, the deviation of the leading edge of the document sheet from the document sheet reference position is corrected and a proper image is reproduced. If a skew of the leading edge of the document sheet to the document sheet reference line is detected from the reflection densities detected by the reflection density detector 35, the copy operation is stopped and an indication is made to request remounting of the document sheet 20 to the operator.

The control by the MP 55 is explained with reference to FIGS. 8A, 8B, 8C, and 8D. The flow charts of FIGS. 8A–8D are programmed and stored in a ROM of the MP 55.

When the image processing apparatus is powered on, it starts warming-up and checks if the moving optical system unit 24 is at the measuring position for the standard white plate 22 (1), and if it is not at the measurement position, the optical system drive motor 39 is rotated backward until the position sensor 30 senses the position detection member 28 (2). If the moving optical system unit 24 is at the measurement position for the standard white plate 22 in the step (1), the optical system drive motor 39 is deactivated (3) and the illumination (irradiation) lamp 25 is turned on (4). Then, the apparatus waits for the input of the shift pulse signal SH, and when the shift pulse signal SH is applied, the A/D in signal is counted to effect the dummy processing (5), and the reflection density of the standard white plate 22 is detected and stored in the designated area of the RAM 56 as the density correction value. Then, the illumination lamp 25 is turned off (7) and the apparatus waits for the input from the copy start key (8). In the flow chart of FIG. 8B, when the copy start key is depressed, whether the current position of the moving optical system 24 is at the measurement position for the standard white plate 22 or not is checked (9), and if the decision is NO, the optical system drive motor 39 is rotated reversely (10). If the decision is YES in the step (9), the optical system drive motor 39 is rotated forwardly (11) to move the moving optical system unit 24 in the sub-scan direction and the illumination lamp 25 is turned on (12). Whether the moving optical system unit 24 has reached the leading edge of the copy permitted area (reproducible area) or not is detected by the position sensor 31 (13), and if the decision is NO, the apparatus stands by until the unit 24 reaches the leading edge. If the decision is YES in the step (13), a predetermined number of A/D in signals are counted after the application of the shift pulse signal SH (16), and after counting, the reflection densities in the main scan direction of the copy permitted area are detected by the photosensing devices 71 and stored (17). Then, whether the reflection densities of all pixels in the copy permitted area have been detected or not is checked (18). If the decision in the step (18) is NO, the steps (16) and (17) are executed again to continue the detection of the reflection densities of the copy permitted area. If the decision in the step (18) is YES, the dummy processing is effected as was done in the step (16) and the illumination lamp 25 is turned off (19). The reflection densities stores in the step (17) are corrected by the density correction value stored in the step (6) and the corrected reflection densities are stored (20).

Figure 8A:
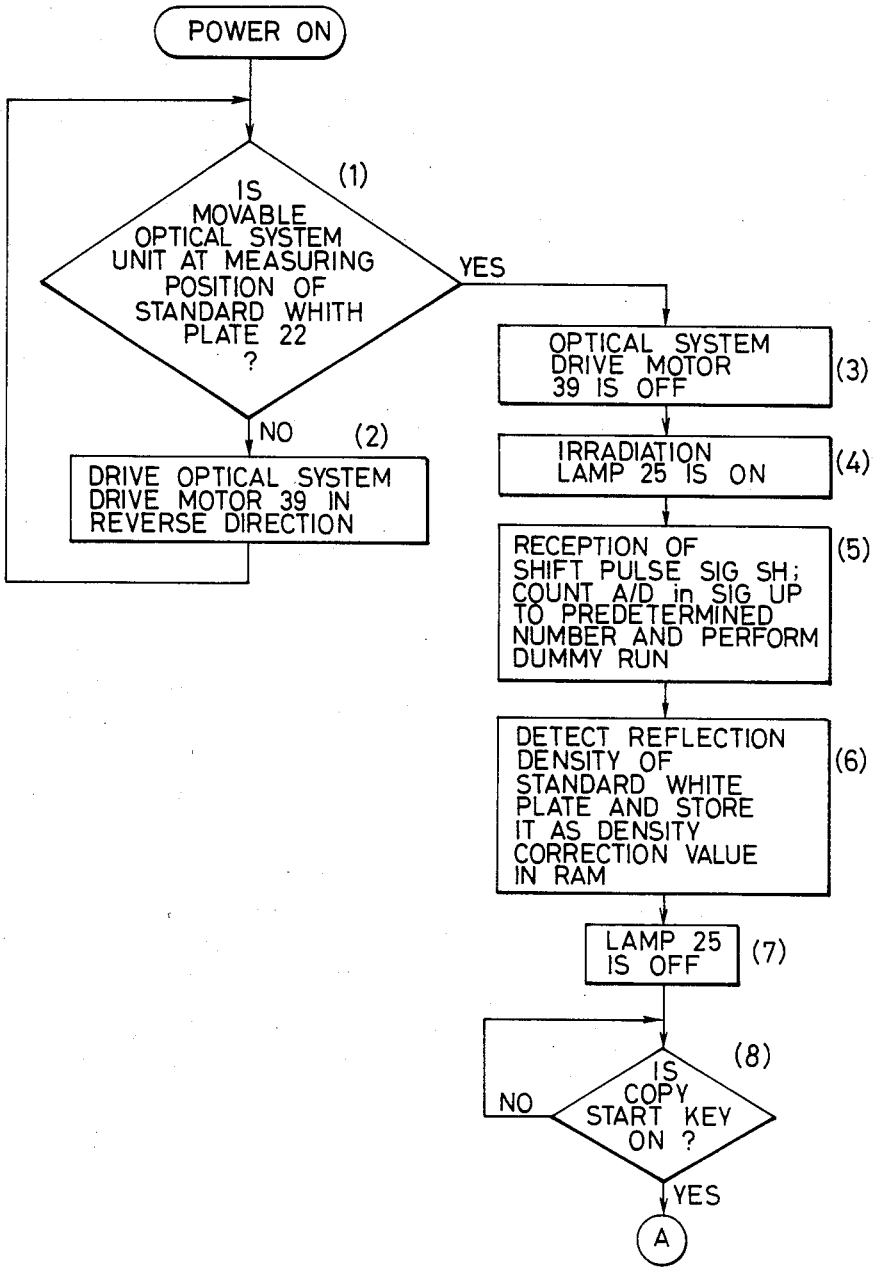
FIGS. 8A, 8B, 8C and 8D show flow control charts in the embodiment.
Figure 8B:
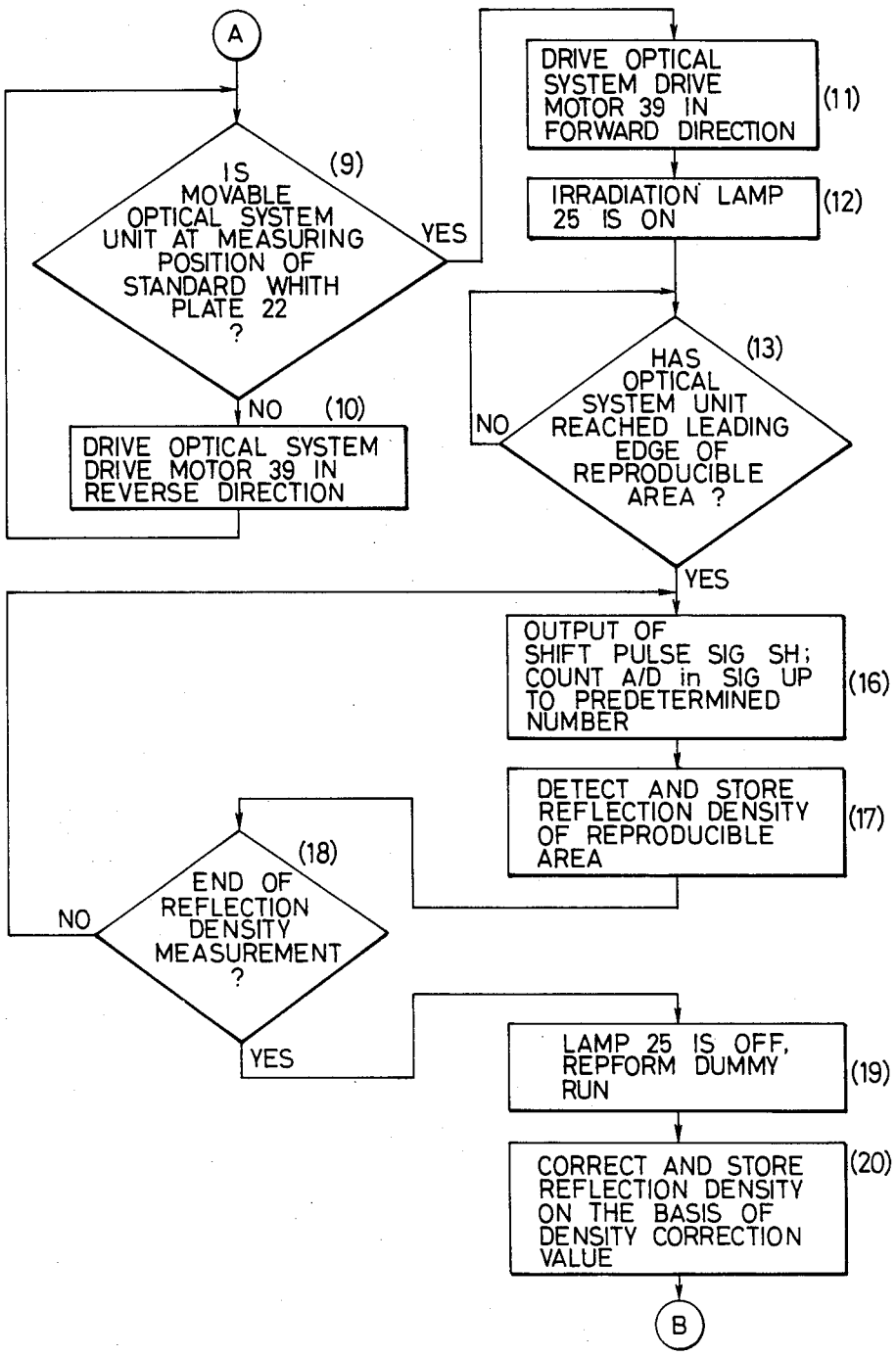
Figure 8C:
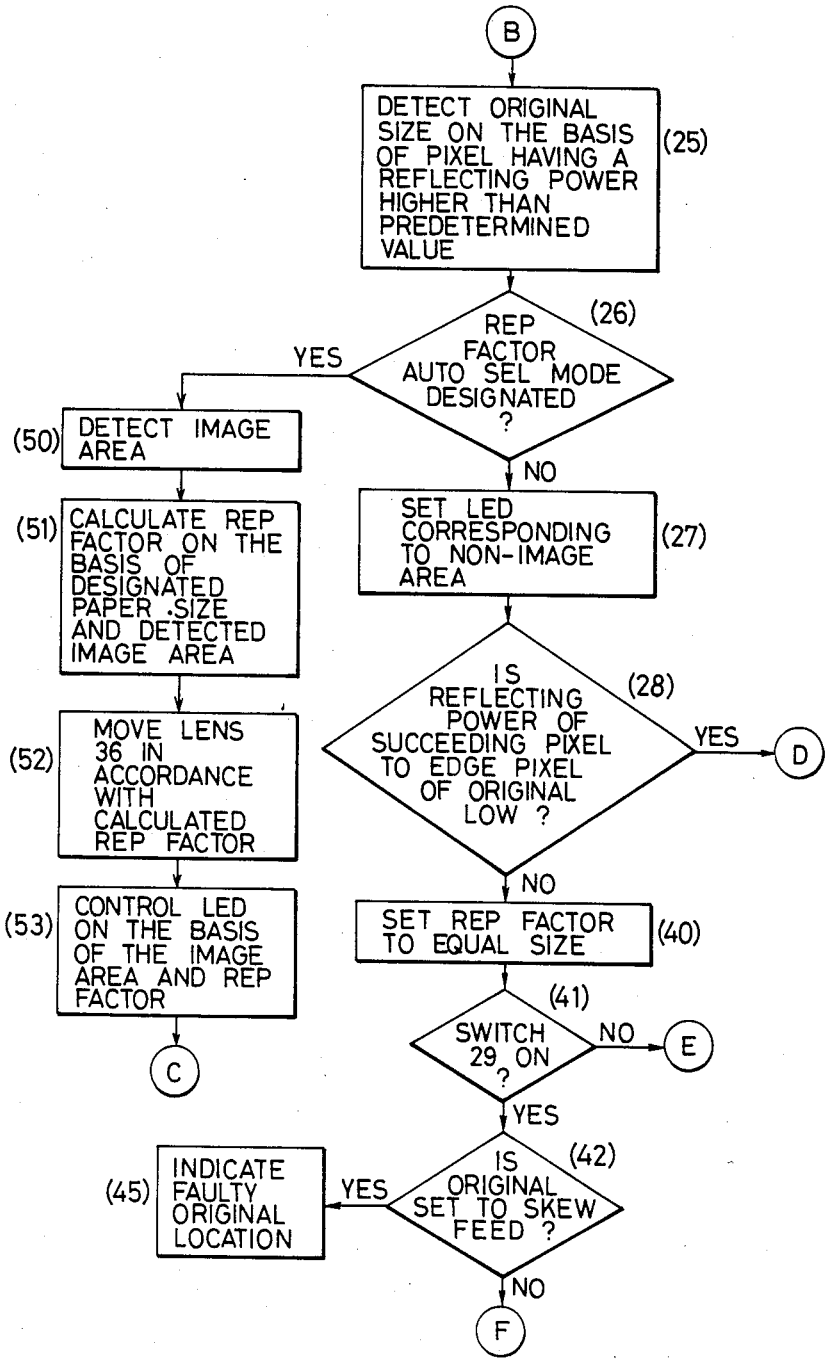
Figure 8D:
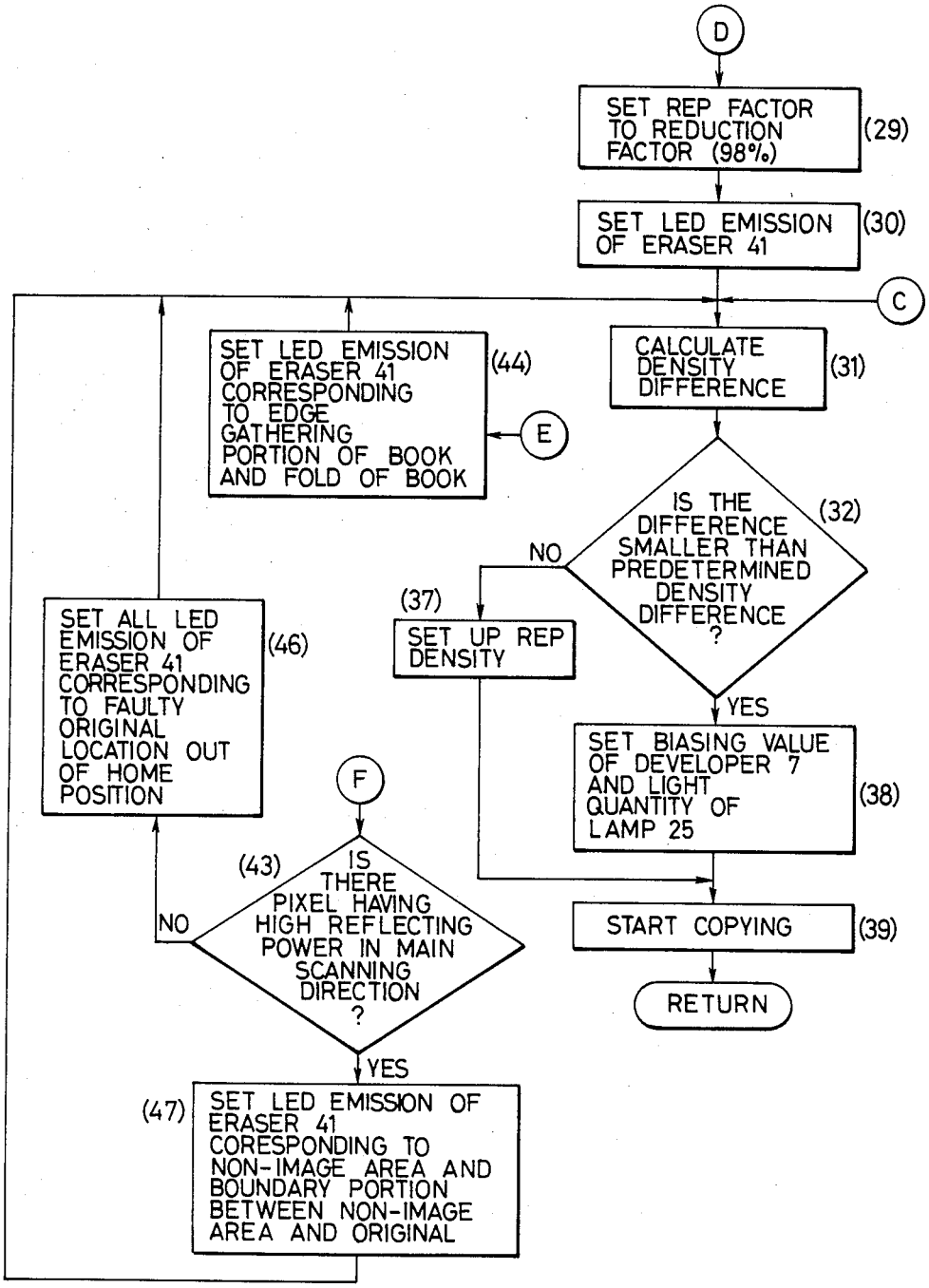

In the flow chart of FIG. 8C, the reflection density data of the pixels stored in the step (20) is examined to detect the document sheet size by the aggregation of pixels having higher reflection factors than a predetermined value (25). Then, whether the automatic magnification selection (reproduction factor automatic selection) mode has been designated or not is checked (26). If the decision is NO, the LED's of the eraser 41 corresponding to the non-image area are turned on (27). The reflection factor (reflecting power) of the pixel next to the edge of the document sheet detected in the step (25) is compared with a predetermined value (28), and if the former is lower, the lens 36 is moved to set the magnification to a predetermined reduction scale (98%)(29), and the LED's of the eraser 41 are turned on (30). The LED's turned on are same as those turned on in the unity magnification. A difference between the maximum and minimum densities in the reflection density data stored in the step (20) is calculated (31), and the difference is compared with a predetermined value (32). If the former is smaller, the bias to the developing unit 7 and the light intensity of the illumination lamp 25 are set in accordance with the reflection densities stored in the step (20), (38), to adjust the contrast, and the copy operation is started (39). If the density difference is larger in the step (32), the copy density is set (37) and the copy operation is started (39).

On the other hand, if the decision in the step (28) is NO, the copy magnification is set to unity (40). Then, the switch 29 is checked (41), and if it is OFF, the document is determined to be a book and the LED's of the eraser 41 corresponding to the edges and the fold of the book are turned on (44). Then, the step (31) is executed. In the steps (41) and (44), the book mode is carried out. If the switch 29 is ON in the step (41), the step (42) is executed to check if the document sheet is mounted obliquely to the document sheet reference position, based on the reflection densities stored in the step (20). If the leading edge of the document sheet is skewed relative to the document sheet reference position by more than a predetermined angle, a step (45) is executed to stop the copy operation and the skew of the document sheet is indicated. If the skew of the document sheet is not detected in the step (42), a step (43) is executed. In the step (43), whether pixels of high reflection factor are present in the main scan direction or not is checked, and if the decision is NO, it is determined that the leading edge of the document sheet is deviated from the document sheet reference position. In a step (46), the LED's of the eraser 41 corresponding to the deviation of the document sheet from the document sheet reference position are turned on. If the decision in the step (43) is YES, the LED's of the eraser 41 corresponding to the border line which is the high reflection factor area in the main scan direction of the document sheet are turned on (47). Then, the step (31) is carried out. In the step (47), the LED's of the eraser 41 corresponding to the non-image area and the border line of the non-image area and the document are turned on to effect the edge processing.

If the automatic magnification selection mode is not designated in the step (26), the image area in the document sheet is detected based on the reflection densities stored in the step (20), (50). A magnification is calculated based on the designated copy sheet size and the image area size such that the entire image area is copied on the copy sheet (51), and then a step (52) is executed. The magnification may be calculated such that a predetermined width of margin always appears on the copy sheet. In the step (52), the lens 36 is driven in accordance with the calculated magnification. The LED's of the eraser 41 are selectively turned on in accordance with the calculated magnification and the image area size (53), and then the step (31) is executed.

While the copying machine of the type in which the image of the document image is directly projected onto the photosensitive material through the lens is shown in the embodiment, the present invention can be applied to an apparatus in which the image data from the reflection density detector 35 are electrically processed into a binary signal and the image is recorded in accordance with the binary signal.

The present invention is not limited to the illustrated embodiment but various modifications may be made within a scope of the appended claims.

What is claimed is:

1. An image processing apparatus, comprising:

detection means for automatically detecting the image area of an image on a document having a document area;

input means for inputting a size of a recording sheet; and determination means for determining a magnification in accordance with the image area detected by said detection means and the size of the recording sheet.

2. An image processing apparatus according to claim 1 further comprising scan means for scanning the document, of wherein said detection means detects the image area of the document as the document is scanned by said scan means.

3. An image processing apparatus according to claim 1 further comprising means for controlling an optical system for changing the magnification in accordance with the magnification determined by said determination means.

4. An image processing apparatus according to claim 1 further comprising a photosensitive material, means for reproducing an image of the document on said photosensitive material at the magnification determined by said determination means, and eraser means for removing charges on said photosensitive material in accordance with the image area and the magnification.

5. An apparatus according to claim 1, wherein said detection means detects the image area on the basis of a density of an image of the document.

6. An image processing apparatus comprising:

process means for reproducing an image on a document onto a recording medium;

detection means for detecting the status of the document image, said detection means including determination means for determining whether the document image is present adjacent an edge of the document, and control means for controlling said process means to reproduce the document image at a predetermined magnification when said determination means determines the presence of the document image adjacent an edge of the document, said control means selecting a reduction magnification when said detection means detects the presence of the document image adjacent an edge of the document.

7. An image processing apparatus according to claim 6 further including eraser means for determining an area for removing charges on said recording medium in accordance with a detection output of said determination means.

8. An apparatus according to claim 6, wherein said determination means determines the presence of the document image adjacent an edge of the document in accordance with a density of the document image.

9. An image forming apparatus comprising:

process means for reproducing a document image on a document onto a recording medium, said process means including reproduction means for reproducing a latent image corresponding to the document image onto the recording medium and eraser means for removing charges on the recording medium;

detection means for detecting the status of the document, said detection means being capable of detecting an edge of the document; and control means for controlling said eraser means in accordance with a detection output from said detection means representing detection of an edge of the doucment in order to modify an edge of a reproduced image corresponding to the document image.

10. An apparatus according to claim 9, wherein said detection means detects both the disposition and size of the document in accordance with a density of the document image.

11. An apparatus according to claim 10, further comprising means for inhibiting image reproduction by said process means in accordance with the status of the document detected by said detection means.

12. An apparatus comprising:

process means for reproducing a document image on a document onto a recording medium, said process means including reproduction means for reproducing a latent image corresponding to the document image on the recording medium and eraser means for removing charges on the recording medium;

detection means for automatically detecting the disposition of the document, said detection means including determination means for determining whether the document is disposed at a reference position;

control means for controlling said eraser means in accordance with distance between the position of the document and the reference position when said determination means determines that the document is not disposed at the reference position; and transfer means for transferring an image reproduced on said recording medium onto a recording sheet, wherein said control means controls a timing for transfer of the recording sheet in association with the distance between the position of the document and the reference position when said determination means determines that the document is not disposed at the reference position.

* * * * *

UNITED STATES PATENT AND TRADEMARK OFFICE

CERTIFICATE OF CORRECTION

PATENT NO. : 4,743,944

DATED : May 10, 1988

INVENTOR(S) : TOMOSADA, MASAHIRO ET AL.

It is certified that error appears in the above-identified patent and that said Letters Patent is hereby corrected as shown below:

HEET 7 FIG. 8A

In Step 1, "STANDARD WHITH" should read --STANDARD WHITE--.

HEET 8 FIG. 8B

In Step 9, "STANDARD WHITH" should read --STANDARD WHITE--.

HEET 8 FIG. 8B

In Step 19, "REPFORM DUMMY" should read --PERFORM DUMMY--.

OLUMN 1

Line 44, "eliminates" should read --eliminate--.
Line 56, "another" should read --an--.

OLUMN 2

Line 18, "an edge or near of" should read --or near an edge of--.
Lines 22-23, "the edge or near" should read --or near the edge--.
Line 24, "to" should read --of--.
Line 35, "accordane" should read --accordance--.
Line 46, "of" should be deleted.
Line 51, "of" should be deleted.

UNITED STATES PATENT AND TRADEMARK OFFICE

CERTIFICATE OF CORRECTION

PATENT NO. : 4,743,944

DATED : May 10, 1988

INVENTOR(S) : TOMOSADA, MASAHIRO ET AL.

It is certified that error appears in the above-identified patent and that said Letters Patent is hereby corrected as shown below:

COLUMN 3

Line 22, "resistration" should read --registration--.

COLUMN 4

Line 39, "ANDS" should read --ANDs--.

COLUMN 5

Line 25, "is" (first occurrance) should be deleted.

COLUMN 6

Line 14, "1~m'M" should read --1~m'~M--.
Line 39, "those" should read --that--.

COLUMN 7

Line 63, "output ports $O$-$O_9$" should read --output ports $O_1$-$O_9$--.

COLUMN 10

Line 39, "regist" should read --register--.

COLUMN 11

Line 3, "value." should read --value (6).--.
Line 8, "system 24" should read --system unit 24--.
Line 33, "stores" should read --stored--.

UNITED STATES PATENT AND TRADEMARK OFFICE

CERTIFICATE OF CORRECTION

PATENT NO. : 4,743,944

DATED : May 10, 1988

INVENTOR(S) : TOMOSADA, MASAHIRO ET AL.

It is certified that error appears in the above-identified patent and that said Letters Patent is hereby corrected as shown below:

COLUMN 12

Line 66, "of" should be deleted.

COLUMN 14

Line 9, "doucment" should read --document--.
Line 33, "distance" should read --the distance--.

Signed and Sealed this

Fourteenth Day of November, 1989

*Attest:*

JEFFREY M. SAMUELS

*Attesting Officer* *Acting Commissioner of Patents and Trademarks*